US010982843B2

(12) United States Patent
Huttunen

(10) Patent No.: US 10,982,843 B2
(45) Date of Patent: Apr. 20, 2021

(54) OVER FIRE ARRANGEMENT AND METHOD

(71) Applicant: Teknologian tutkimuskeskus VTT Oy, Espoo (FI)

(72) Inventor: Marko Huttunen, Espoo (FI)

(73) Assignee: TEKNOLOGIAN TUTKIMUSKESKUS VTT OY, Espoo (FI)

( * ) Notice: Subject to any disclaimer, the term of this patent is extended or adjusted under 35 U.S.C. 154(b) by 222 days.

(21) Appl. No.: 16/314,528

(22) PCT Filed: Jun. 29, 2017

(86) PCT No.: PCT/FI2017/050488
§ 371 (c)(1),
(2) Date: Dec. 31, 2018

(87) PCT Pub. No.: WO2018/002441
PCT Pub. Date: Jan. 4, 2018

(65) Prior Publication Data

US 2019/0323705 A1 Oct. 24, 2019

(30) Foreign Application Priority Data

Jul. 1, 2016 (FI) ..... 20165555

(51) Int. Cl.
*F23C 6/04* (2006.01)
*F23C 5/08* (2006.01)
(Continued)

(52) U.S. Cl.
CPC ..... *F23C 6/047* (2013.01); *F23C 5/08* (2013.01); *F23C 7/002* (2013.01);
(Continued)

(58) Field of Classification Search
CPC .... F23D 1/00; F23C 5/08; F23C 6/047; F23C 2201/101; F23C 7/002; F23C 5/28; F27B 3/16; F23L 9/02
See application file for complete search history.

(56) References Cited

U.S. PATENT DOCUMENTS

| | | | |
|---|---|---|---|
| 4,312,702 | A | 1/1982 | Tomlinson, II |
| 6,279,495 | B1 | 8/2001 | Karidio et al. |
| 2014/0308620 | A1 | 10/2014 | Deng et al. |

FOREIGN PATENT DOCUMENTS

| | | |
|---|---|---|
| CA | 2 508 380 | 11/2006 |
| CN | 1873325 | 12/2006 |

(Continued)

OTHER PUBLICATIONS

Office Action issued in China Appln. No. 201780047671.5 dated Dec. 23, 2019 (with translation).

(Continued)

*Primary Examiner* — Alfred Basichas
(74) *Attorney, Agent, or Firm* — Nixon & Vanderhye P.C.

(57) ABSTRACT

The present invention relates to an over fire air arrangement for a furnace (1), the furnace (1) having opposing first wall (4) and second wall (6) and opposing first side wall (5) and second side wall (7) between the first and second walls (4, 6) for forming a furnace enclosure (2). The over fire air arrangement comprising at least one first over fire air port (20) provided to the first wall (4) for supplying a first over fire air flow (40) into the furnace (1) and at least one first additional over fire air port (50) provided to at least one of the first and second side walls (5, 7) in the vicinity of the first wall (4), the at least one first additional over fire air port (50) being arranged to supplying a first additional over fire air flow (60) into the furnace (1) transversely to the first over fire air flow (40).

3 Claims, 12 Drawing Sheets

(51) Int. Cl.

| | |
|---|---|
| *F23C 7/00* | (2006.01) |
| *F23L 9/02* | (2006.01) |
| *F27B 3/16* | (2006.01) |

(52) U.S. Cl.

CPC ..... *F23C 2201/101* (2013.01); *F23L 9/02* (2013.01); *F27B 3/16* (2013.01)

(56) References Cited

FOREIGN PATENT DOCUMENTS

| | | |
|---|---|---|
| CN | 101737771 | 6/2010 |
| CN | 102721043 | 10/2012 |
| EP | 1 467 148 | 10/2004 |
| EP | 1 936 269 | 6/2008 |
| JP | 2007-57138 | 3/2007 |
| WO | 98/35185 | 8/1998 |
| WO | 2010/037088 | 4/2010 |

OTHER PUBLICATIONS

International Search Report for PCT/FI2017/050488, dated Oct. 20, 2017, 4 pages.
Written Opinion of the ISA for PCT/FI2017/050488, dated Oct. 20, 2017, 6 pages.
Search Report for FI20165555, dated Jan. 19, 2017, 2 pages.
Office Action for FI20165555, dated Dec. 17, 2018, 6 pages.

OVER FIRE ARRANGEMENT AND METHOD

This application is the U.S. national phase of International Application No. PCT/FI2017/050488 filed 29 Jun. 2017, which designated the U.S. and claims priority to FI Patent Application No. 20165555 filed 1 Jul. 2016, the entire contents of each of which are hereby incorporated by reference.

FIELD OF THE INVENTION

The present invention relates to an over fire air arrangement and more particularly to an over fire air arrangement according to the preamble of claim 1. The present invention also relates to a method for supplying over fire air into a furnace, and more particularly to a method according to the preamble of claim 12.

BACKGROUND OF THE INVENTION

Nitrogen oxides (NOx) are unwanted byproducts of combustion processes, such as combusting fossil fuels. NOx emissions from combustion processes have negative effects on environment by causing acid rains. In the prior art NOx emissions have been reduced by staged combustion of fuels in the furnace or staged air supply into the furnace. This means that the fuel is burned in stages. In principle, increasing the staging of the combustion process the NOx emissions may be decreased. However, increasing the staging of the combustion process increases the amount of unburns, including carbon monoxide (CO). Increased unburns decrease the combustion efficiency and also cause emissions. The increase of unburns may be prevented by using over fire air arrangement in which air is supplied to the upper furnace for good burn-out of the fuel after staged combustion.

In prior art over fire air arrangements there are usually one or two levels of over fire air ports provided to furnace walls in upper furnace and in vertical direction over the lower furnace in which the staged combustion is carried out. In these prior art over fire air arrangements the over fire air is supplied from one furnace wall or two opposing furnace walls towards the centre of the furnace. Thus the over fire air improves burn-out of fuel when the staged combustion is used.

However, one of the disadvantages of prior art over fire air arrangements is that the mixing of the over fire air and coverage of the whole upper furnace is inadequate for achieving good burn-out of fuel in the whole upper furnace area. This compromises the combustion efficiency and also generates unwanted unburn emissions.

BRIEF DESCRIPTION OF THE INVENTION

An object of the present invention is therefore to provide an over fire air arrangement and method for supplying over fire air into a furnace so as to overcome or at least alleviate the prior art disadvantages. The objects of the invention are achieved by an over fire arrangement according to the characterizing portion of claim 1. The objects of the invention are further achieved by a method according to the characterizing portion of claim 12.

The preferred embodiments of the invention are disclosed in the dependent claims.

The invention is based on the idea of providing an over fire air arrangement for a furnace having opposing first wall and second wall and opposing first side wall and second side wall between the first and second walls for forming a furnace enclosure. The over fire air arrangement comprises at least one first over fire air port provided to the first wall for supplying a first over fire air flow into the furnace and at least one first additional over fire air port provided to at least one of the first and second side walls in the vicinity of the first wall, the at least one first additional over fire air port being arranged to supplying a first additional over fire air flow into the furnace transversely to the first over fire air flow.

In an alternative embodiment the over fire air arrangement further comprises at least one second over fire air port provided to the second wall for supplying a second over fire air flow into the furnace and at least one second additional over fire air port provided to at least one of the first and second side walls in the vicinity of the second wall, the at least one second additional over fire air port being arranged to supplying a second additional over fire air flow into the furnace transversely to the second over fire air flow.

In one embodiment of the invention the first and second additional over fire air ports are arranged to supply the first and second additional over fire air flows along and in vicinity of the first and second walls respectively.

In one embodiment of the invention the invention the first and second additional over fire air ports are arranged to supply the first and second additional over fire air flows parallel the first and second walls respectively, or parallel and along the first and second walls, respectively.

In yet another embodiment of the invention the invention the first and second additional over fire air ports are arranged to supply the first and second additional over fire air flows perpendicularly to the first and second over fire air flows, or parallel and along the first and second walls, respectively, and perpendicularly to the first and second additional over fire air flows.

The first and second over fire air ports provided to the first and second wall, respectively, are arranged to provide together with the first and second additional over fire air ports a crossflow of over fire air into the furnace.

The invention is further based on the idea of supplying over fire air into a furnace, the furnace having opposing first wall and second wall and opposing first side wall and second side wall between the first and second walls for forming a furnace enclosure. The method comprises supplying a first over fire air flow from the first wall into the furnace and supplying a first additional over fire air flow from at least one of the first and second side walls in the vicinity of the first wall and transversely to the first over fire air flow.

In one embodiment of the invention the method further comprises supplying a second over fire air flow from the second wall into the furnace and supplying a second additional over fire air flow from at least one of the first and second side walls in the vicinity of the second wall and transversely to the second over fire air flow.

When air is supplied from the over fire air ports provided to the first and second opposing walls of the furnace, the over fire air flows are directed towards the centre or opposite wall of the furnace. Thus an oxygen rich area is formed in the centre of the furnace or towards the opposite wall of the furnace. At the same time on oxygen lean area is formed in the vicinity of the first and second walls via which over fire air is supplied in to the furnace. This is due to the fact that the over fire air flows flow away from the first and second walls via which they are supplied and start to rise upwards in the furnace. According to the present invention additional over fire flows are supplied from at least one of the side walls of the furnace in the vicinity of the first and second walls and substantially along the first and second wall. Thus additional over fire air is supplied into the oxygen lean area.

The additional over fire air flows provide oxygen to the oxygen lean area in vicinity of the first and second walls via which the over fire air is supplied. The additional over fire air enhances the burn-out of fuel and thus decreases the amount of unburns in the combustion process. The additional over fire air flows may also provide shield flows and decrease corrosion tendency of the first and second walls of the furnace.

BRIEF DESCRIPTION OF THE DRAWINGS

In the following the invention will be described in greater detail by means of preferred embodiments with reference to the attached [accompanying] drawings, in which.

DETAILED DESCRIPTION OF THE INVENTION

Figure 1:
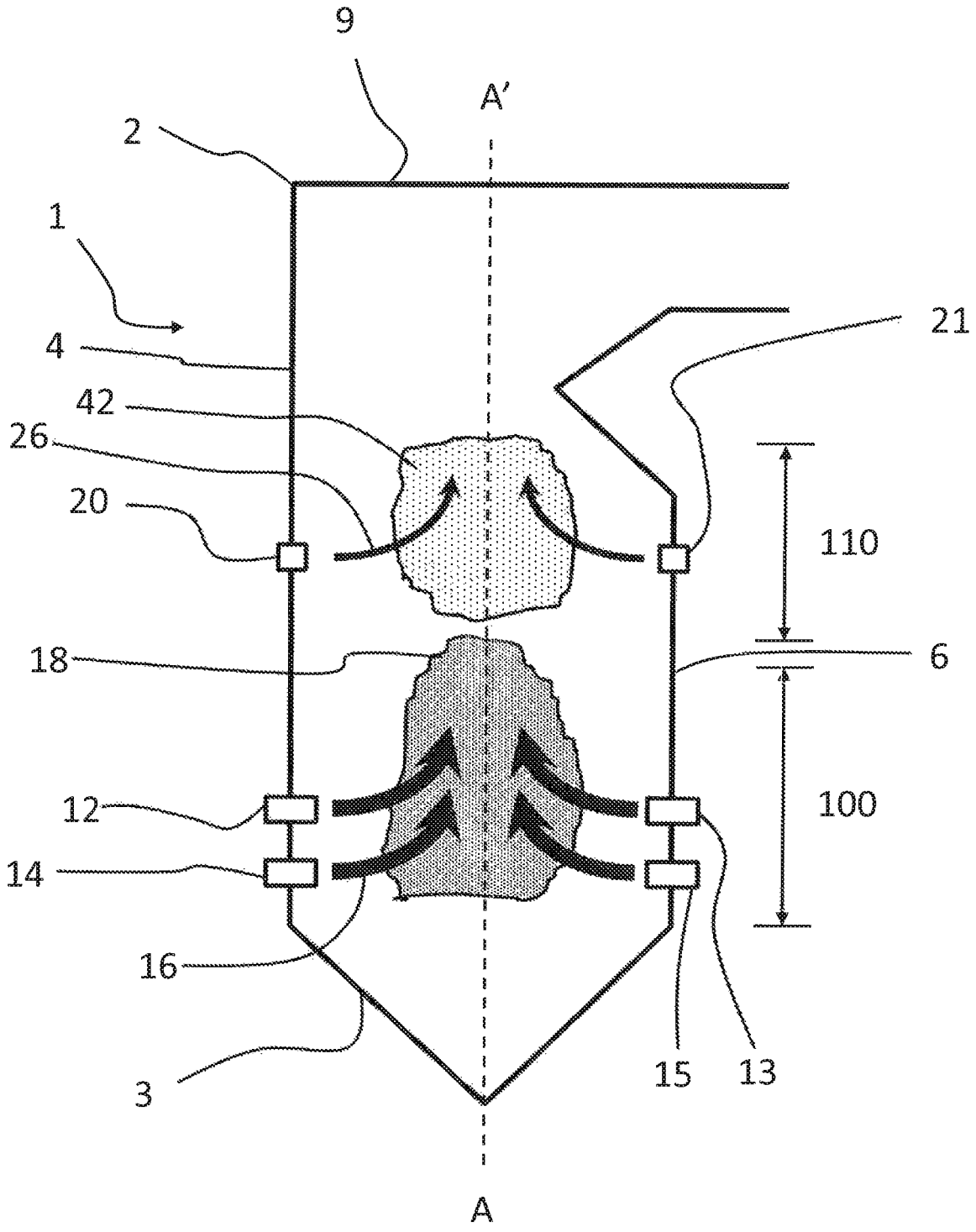
FIG. 1 shows schematic view of prior art furnace.
Figure 2A:
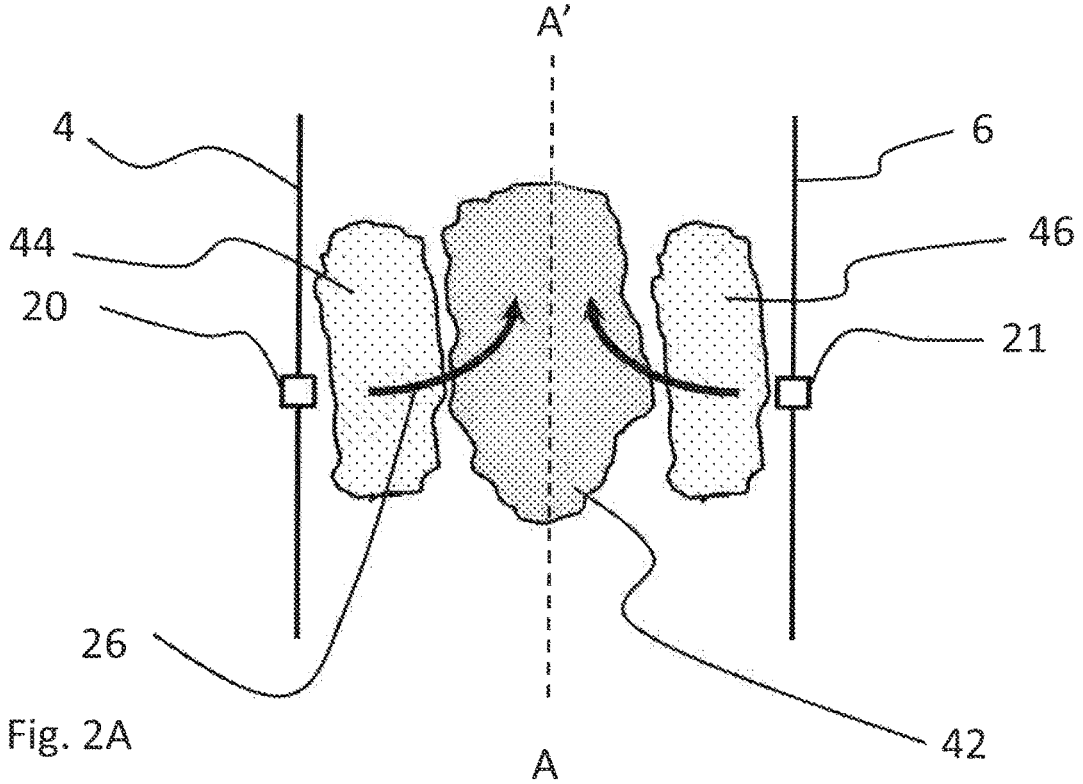
FIGS. 2A and 2B show a prior art over fire air arrangement of the furnace of FIG. 1.
Figure 2B:
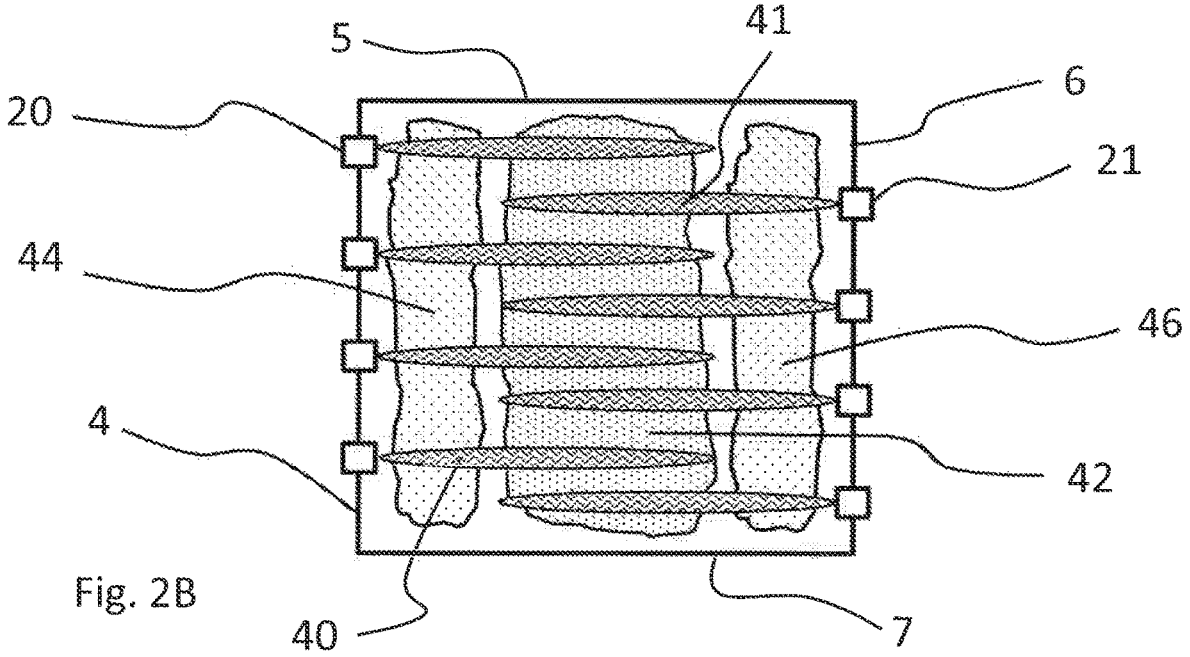

FIG. 1 shows a prior art furnace 1 having a bottom 3 and top 9, and opposing front wall 4 and rear wall 6 as well as opposing first and second side wall 5, 7 (shown in FIG. 2B). The front wall 4 and rear wall 6 as well as opposing first and second side wall 5, 7 form together an enclosure 2 of the furnace 1, as shown in FIG. 2B. The furnace 1 comprises burners 14, 12, 10, 15, 13, 11 provided to the opposing first and second walls 4, 6 of the furnace for combusting fuel. In this embodiment the furnace comprises at least one first primary burner 14 provided to the first wall 4 and at least one second primary burner 15 provided to the second wall 6 for forming a first level of burners and first combustion stage. The furnace 1 further comprises at least one first secondary burner 14 provided to the first wall 4 and at least one second secondary burner 15 provided to the second wall 6, the secondary burners being arranged above the primary burners 14, 15 in vertical direction for staged combustion of fuel. The secondary burners 12, 13 form a second level of burners and second combustion stage. The combustion products of the burners 14, 15, 12, 13 flow towards the centre of the furnace 1 as shown by the arrows 16. Thus the opposing burners 14, 15, 12, 13 form a staged combustion zone 18 at the lower furnace 100.

It should be noted that the furnace 1 may comprise at least one primary burner 14, 15 and at least one secondary burner 12, 13 in vertical direction above the at least one primary burner 14, 15 for providing staged combustion. The furnace 1 may also comprise tertiary or further burner levels for forming more than two combustion stages. Furthermore, burners may also be provided only on one wall of the furnace 1.

The furnace further comprises an over fire air arrangement comprises one or more over fire air ports 20, 21 provided to the upper furnace 110 above the lower furnace 100. In the embodiment of FIG. 1 the furnace comprises at least one first over fire air port 20, provided to the first wall 4 and at least one second over fire air port 21 provided to the second wall 6. It should be noted that the first or second over fire air ports 20, 21 may also be omitted such that over fire air is supplied only from one wall of the furnace 1.

In the context of this application the over fire air ports 20, 21 may be provided on the same wall with the burners 14, 12, 15, 13 or alternatively on adjacent walls. Therefore, the arrangement of the over fire air ports 20, 21 is not dependent on the arrangement of burners 14, 12, 15, 13 combustion air ports provided to the lower furnace 100.

The over fire air ports 20, 21 supply over fire air flows in the direction of arrows 26 such that on oxygen rich over fire air area 42 is formed in the centre of the upper furnace 110. FIG. 2A shows this in more detail as a side view of the upper furnace 110. When the oxygen rich over fire air area 42 is formed, first and second oxygen lean over fire air area 44, 46 is formed in the vicinity of the first and second walls 4, 6, respectively, as the over fire air flows towards the vertical centre line A-A' of the furnace 1.

FIG. 2B shows a top view of the upper furnace 110. The first and second over fire air ports 20 and 21 are arranged overlapped to the first and second walls 4, 6 towards each other, such that the first and second over fire air flows 40, 41 produced by the first and second over fire air ports 20, 21 overlap at the centre of the furnace 1, as shown in FIG. 2B. Thus an oxygen rich over fire air area 42 is formed in the centre of the furnace 1 and first and second oxygen lean over fire air area 44, 46 is formed in the vicinity of the first and second walls 4, 6, respectively.

Figure 3:
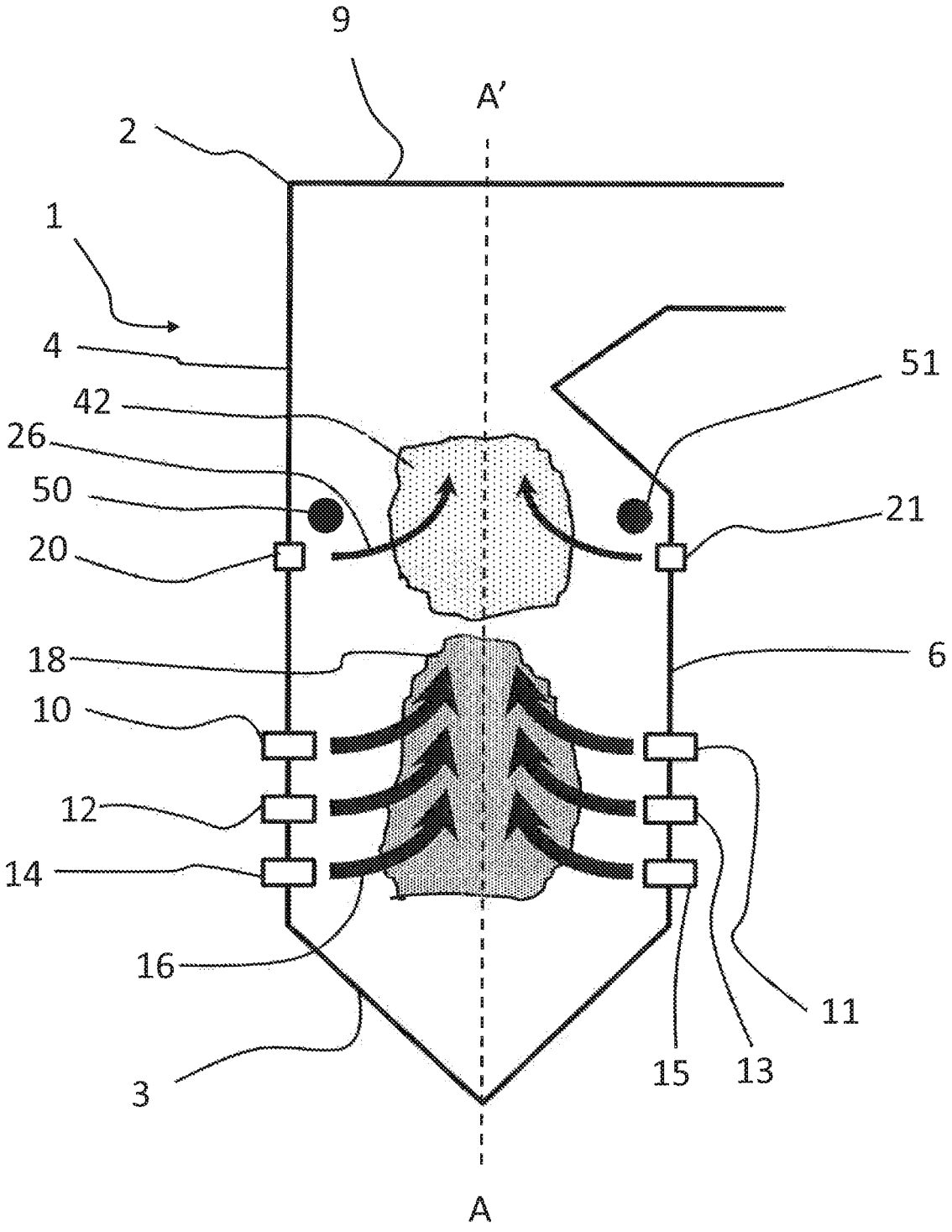
FIG. 3 shows a furnace with one embodiment of the over fire arrangement according to the present invention.
Figure 4A:
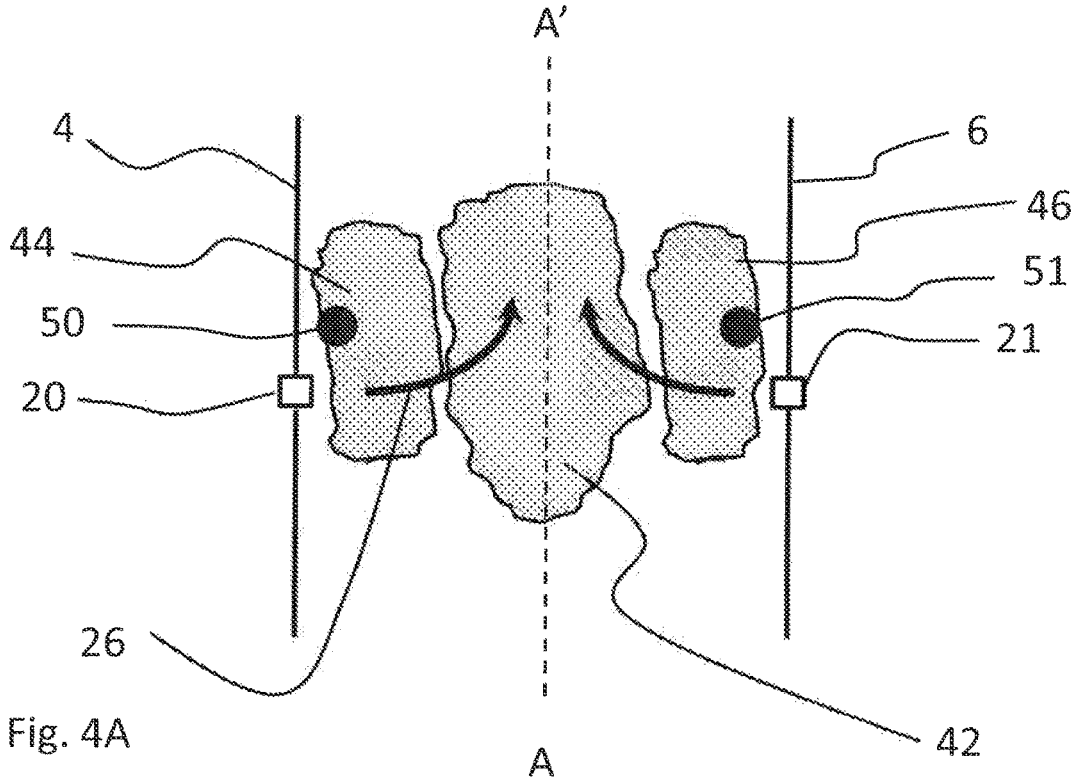
FIGS. 4A and 4B show the over fire air arrangement of FIG. 3.

FIG. 3 shows a furnace 1 and over fire air arrangement according to the present invention. The furnace 1 of FIG. 3 corresponds the furnace of FIG. 1, and therefore repeating the description of the structure is omitted. The over fire air arrangement of the furnace 1 of FIG. 3 comprises further additional over air ports 50, 51 for supplying additional over fire air to the upper furnace 110, as shown in greater detail in FIG. 4A. The additional over air ports 50, 51 are arranged to supply over fire air to the oxygen lean over fire air areas 44, 46.

Figure 4B:
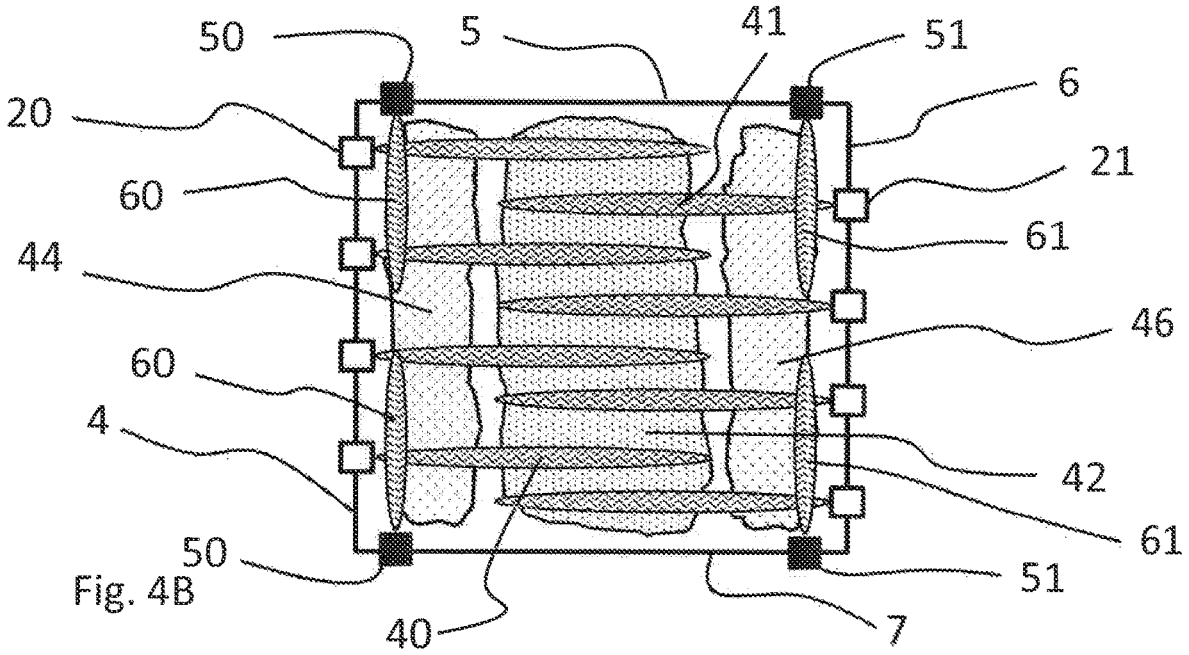

The additional over air ports 50, 51 are provided to the first and second side walls 5, 7 as shown in FIG. 4B. The furnace 1 of the embodiment of FIGS. 3, 4A and 4B may comprise at least one first additional over fire air port 50 provided to the first side wall 5 and second side wall 7 and at vicinity of the first wall 4 and arranged to supply first additional over fire air flows 60 to the first oxygen lean over fire air area 44 in the vicinity of the first wall 4. The furnace 1 may further comprise at least one second additional over fire air port 51 provided to the first side wall 5 and or second side wall 7 and at vicinity of the second wall 6 and arranged to supply second additional over fire air flows 61 to the second oxygen lean over fire air area 46 in the vicinity of the second wall 4. Accordingly the first and second additional over fire ports 50, 51 are arranged to supply the first and second additional over fire air flows 60, 61 into the furnace 1 transversely to the first and second over fire air flow 40, 41 and to the first and second oxygen lean over fire air area 44, 46. It should be noted that there may also be only one first additional over fire air port 50 and only one second additional over fire air port 51 provided to the first or second side wall 5, 7.

Figure 5:
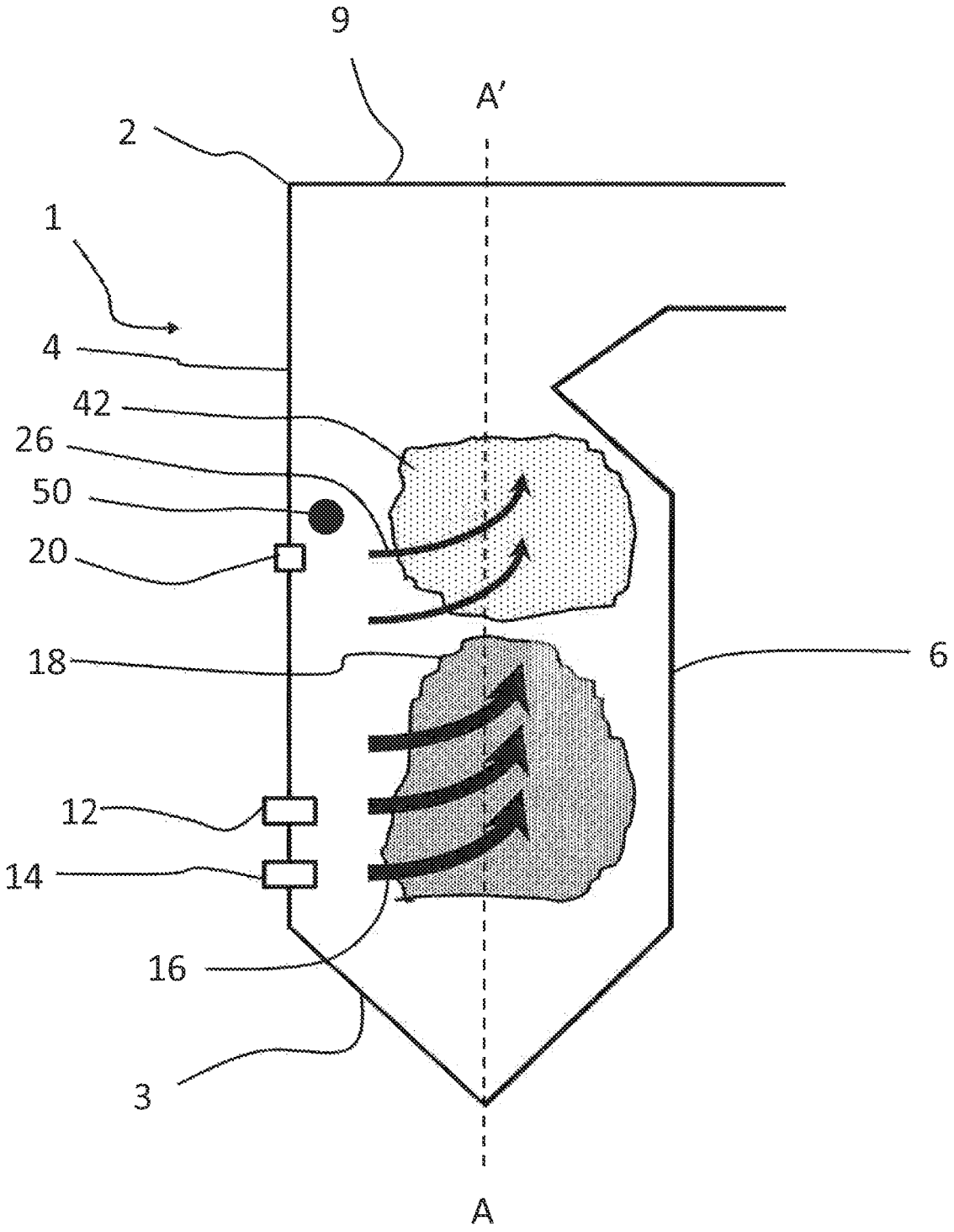
FIG. 5 shows a furnace with another embodiment of the over fire arrangement according to the present invention.
Figure 6A:
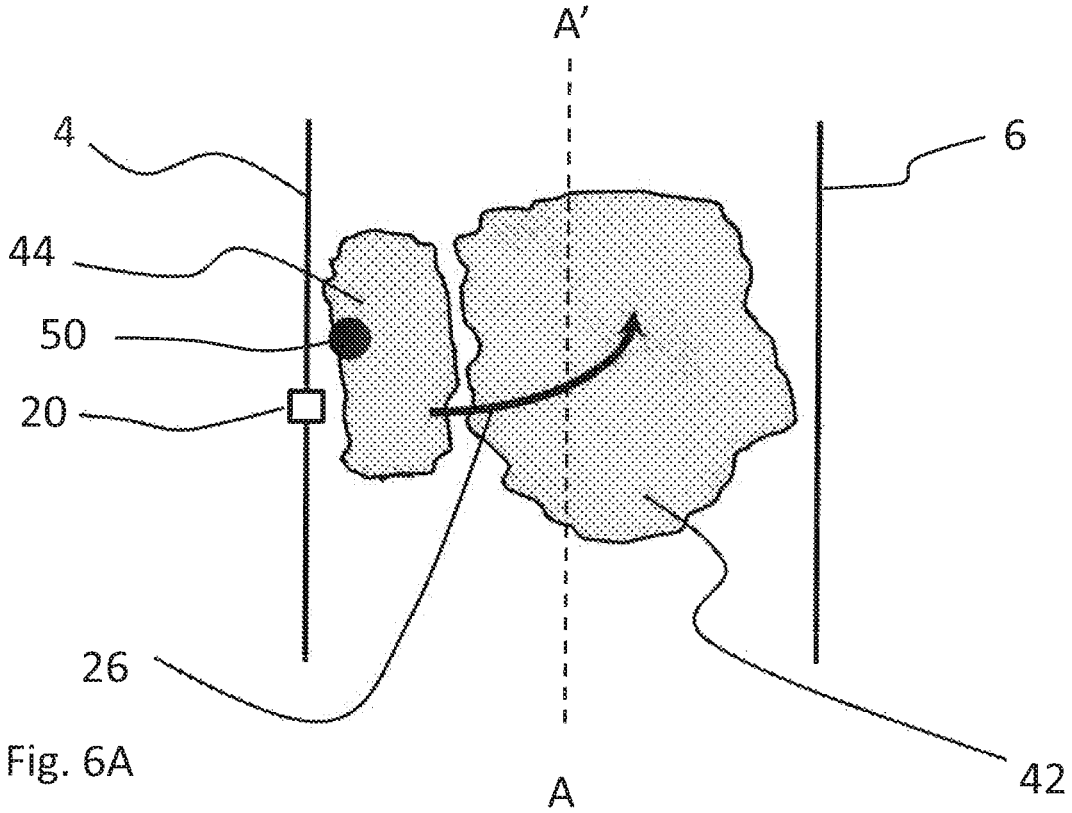
FIGS. 6A and 6B show the over fire air arrangement of FIG. 5.
Figure 6B:
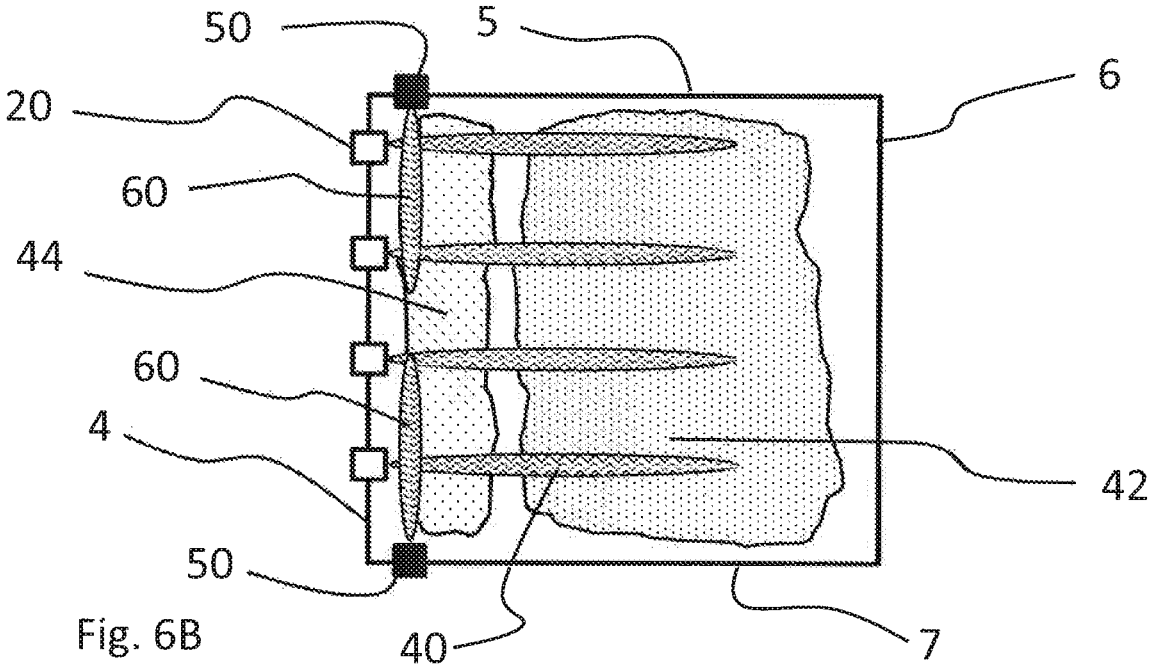

FIG. 5 shows a modification of the furnace 1 of FIG. 3. The furnace 1 of FIG. 5 comprises only first burners 14, 12 provided to the first wall 4 and only first over furnace air ports 20 provided also to the first wall 4. Thus the furnace 1 provides a single wall combustion furnace. The over fire air arrangement of this embodiment also comprises only at least one first additional over fire air ports 50 provided to the first side wall 5 and second side wall 7 and at vicinity of the first wall 4 and arranged to supply first additional over fire air flows 60 to the first oxygen lean over fire air area 44 in the vicinity of the first wall 4, as shown in FIGS. 6A and 6B. FIG. 6A shows, that in this embodiment the oxygen rich over fire air area 42 is formed in the centre of the upper furnace 110 and also in the vicinity of the second wall 6 in the upper furnace 110. This due to the fact that there is not opposing over air supply ports and thus the first over fire air flows 40 supplied from the first over fire air ports 20 flow towards to second wall 6 via the centre of the furnace 1. Accordingly, the first oxygen lean over fire air area 44 is formed in the vicinity of the first wall 4, but not in the vicinity of the second wall 6. The first additional over air ports 50 are provided to the first and second side walls 5, 7 as shown in FIG. 6B. The furnace 1 of the embodiment of FIGS. 5, 6A and 6B may comprise at least one first additional over fire air port 50 provided to the first side wall 5 and second side wall 7 and at vicinity of the first wall 4 and arranged to supply first additional over fire air flows 60 to the first oxygen lean over fire air area 44 in the vicinity of the first wall 4. It should be noted that there may also be only one first additional over fire air port 50 provided to the first or second side wall 5, 7.

It should be noted that also in single wall combustion furnace the over fire air ports may be provided on two opposite walls of furnace in the same way as shown in context of FIG. 3.

Furthermore, it should be noted that the present invention is not restricted to any special type on furnace, but the over fire arrangement according to the present invention may be utilized in any type of furnaces. For example, the furnace may be single wall combustion furnace, opposite wall fired furnace, corner fired furnace, a grate furnace, bubbling fluidized bed furnace or even a circulating fluidized bed furnace. The present invention is not restricted to any particular fuel, but fuel used in the furnace may be any known fuel.

According to the above mentioned, the over fire air arrangement of the present invention comprises at least one first over fire air port 20 on the first wall 4 and at least one first additional over fire air port 50 provided to at least one of the first and second side walls 5, 7 in the vicinity of the first wall 4. The at least one first additional over fire air port 50 is arranged to supplying the first additional over fire air flow 60 into the furnace 1 transversely to the first over fire air flow 40 of the at least one first over fire air port 2. Alternatively the upper furnace 110 may also comprise at least one second over fire air port 21 provided to the second wall 6 and at least one second additional over fire air port 51 provided to at least one of the first and second side walls 5, 7 in the vicinity of the second wall 6. The at least one second additional over fire air port 51 being arranged to supplying a second additional over fire air flow 61 into the furnace 1 transversely to the second over fire air flow 41 of the at least one second over fire air port 21.

As described above and shown in FIGS. 3 to 6B, above the additional over fire air ports 50, 51 may be arranged to supply the first and second additional over fire air flows 60, 61 along the first and second walls 4, 6 respectively. In one detailed embodiment the additional over fire air ports 50, 51 may be arranged to supply the first and second additional over fire air flows 60, 61 parallel the first and second walls 4, 6 respectively. In another detailed embodiment the additional over fire air ports 50, 51 may be arranged to supply the first and second additional over fire air flows 60, 61 perpendicularly to the first and second over fire air flows 40, 41. Accordingly, the additional over fire air ports 50, 51 are arranged to provide a crossflow of over fire air to the furnace 1 and especially to the to the oxygen lean over fire air areas 44, 46.

FIGS. 7A, 7B, 7C and 7D show different kinds of over fire air arrangement in which the additional over fire air ports 50, 51 are arranged differently. All the alternatives are in the scope of the present invention.

the first and second additional over fire air ports (50, 51) are arranged such that:

As described above the first and second additional over fire air ports 50, 51 are arranged in the vicinity of the first and second walls 4, 6, respectively. The term in the vicinity means that the first and second additional over fire air ports 50, 51 are arranged such that the a first distance z between the first and second additional air port 50, 51 and the first and second wall 4, 6, respectively, is smaller than a second distance y between the first and second additional air port 50, 51 and a vertical centre line A-A' of the furnace enclosure 2, as shown in all FIGS. 7A, 7B, 7C and 7D.

In one embodiment the first and second additional over fire air ports 50, 51 are arranged such that first distance z between the first and second additional air port 50, 51 and the first and second wall 4, 6, respectively, is smaller than or equal to one third of a third distance x between the a vertical centre line A-A' of the furnace enclosure 2 and the first and second wall 4, 6, respectively.

In an alternative embodiment the first and second additional over fire air ports 50, 51 are arranged such that the first distance z between the first and second additional air port 50, 51 and the first and second wall 4, 6, respectively, is smaller than a second distance y between the first and second additional air port 50, 51 and a vertical centre line A-A' of the furnace enclosure 2, and that the first distance z is smaller than 2.0 m, or preferably the first distance z is between 0.3-1.0 m.

According to the present invention the first and second additional over fire air ports 50, 51 are arranged above the over fire air ports 20, 21 in the vertical direction of the furnace 1. The first and second additional over fire air ports 50, 51 may also be arranged even below the over fire air ports 20, 21 in the vertical direction of the furnace 1.

Figure 7A:
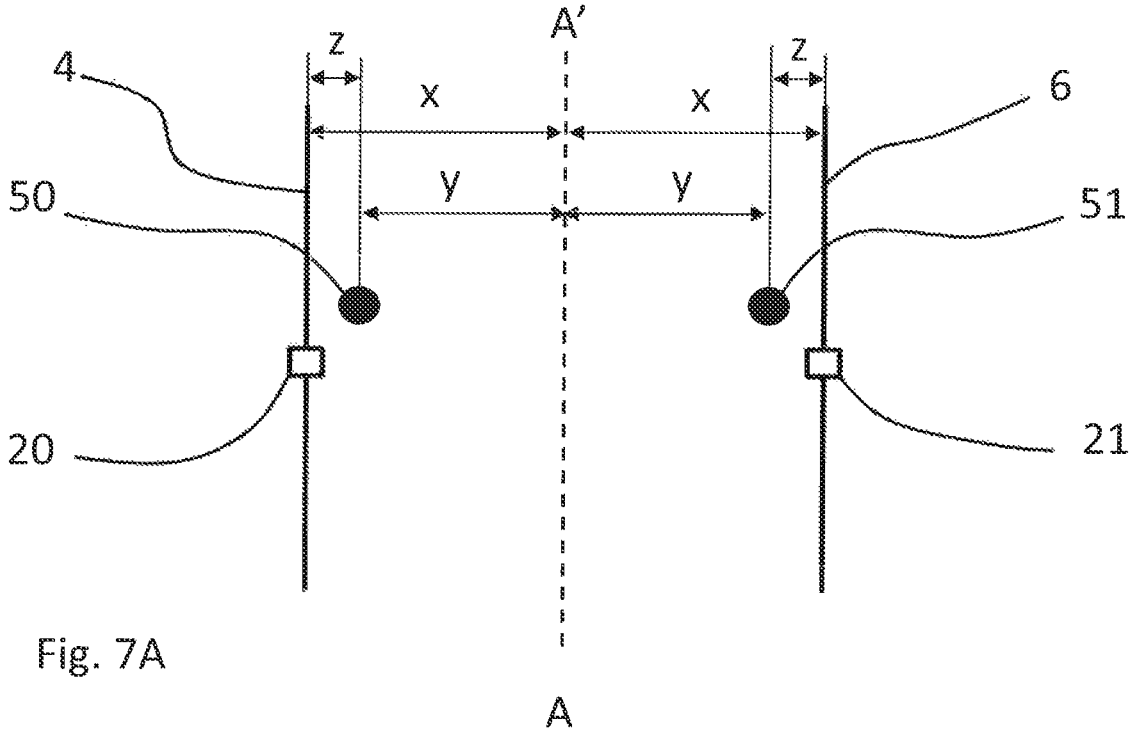
FIGS. 7A, 7B, 7C and 7D show different embodiments of the over fire arrangement for the furnace of FIG. 5.
Figure 7B:
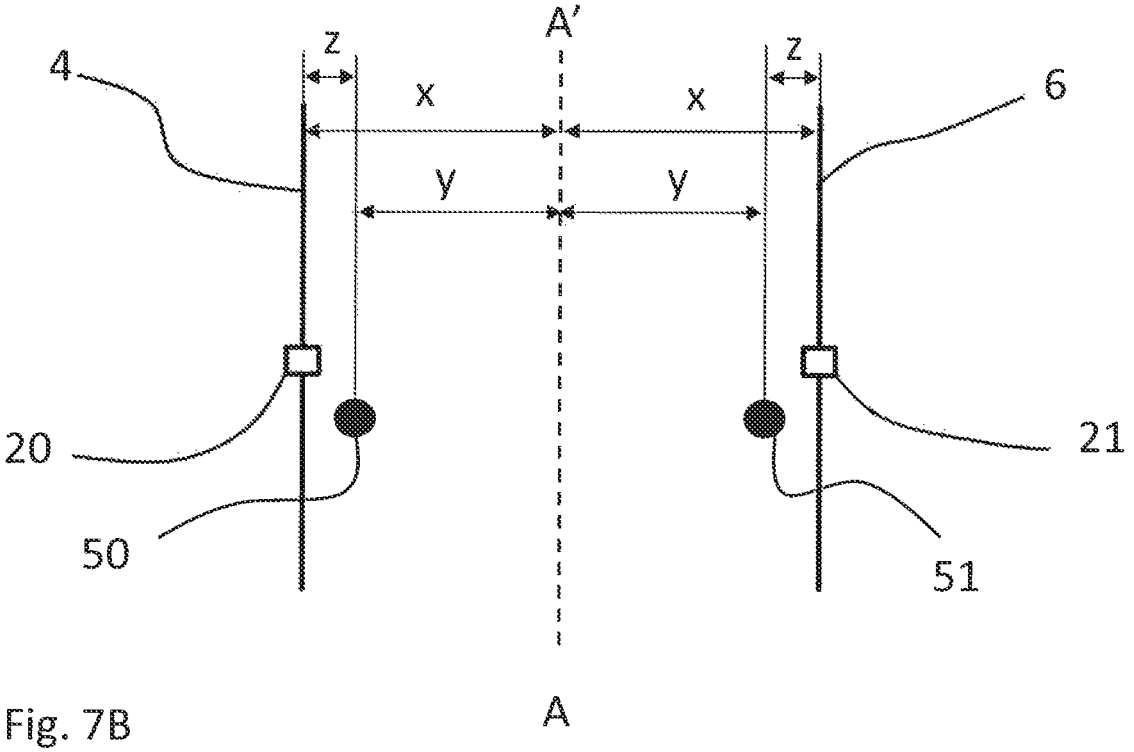

FIG. 7A shows one embodiment of the present invention in which the first and second additional over fire air ports 50, 51 are arranged above the over fire air ports 20, 21 in the vertical direction of the furnace 1. In one embodiment the first and second additional over fire air ports 50, 51 may be in vertical direction less than 2.0 m, preferably 0.3-1.0 m, above the first and second over fire air ports 20, 21. In an alternative embodiment shown in FIG. 7B, the first and second additional over fire air ports 50, 51 are in vertical direction below the first and second over fire air ports 20, 21.

The over fire air arrangement may also comprise at least one first primary over fire air port 20 and at least one first secondary over fire air port 22 provided to the first wall 4.

The first secondary over fire air port 22 is arranged in vertical direction above the first primary over fire air port 20.

Figure 7C:
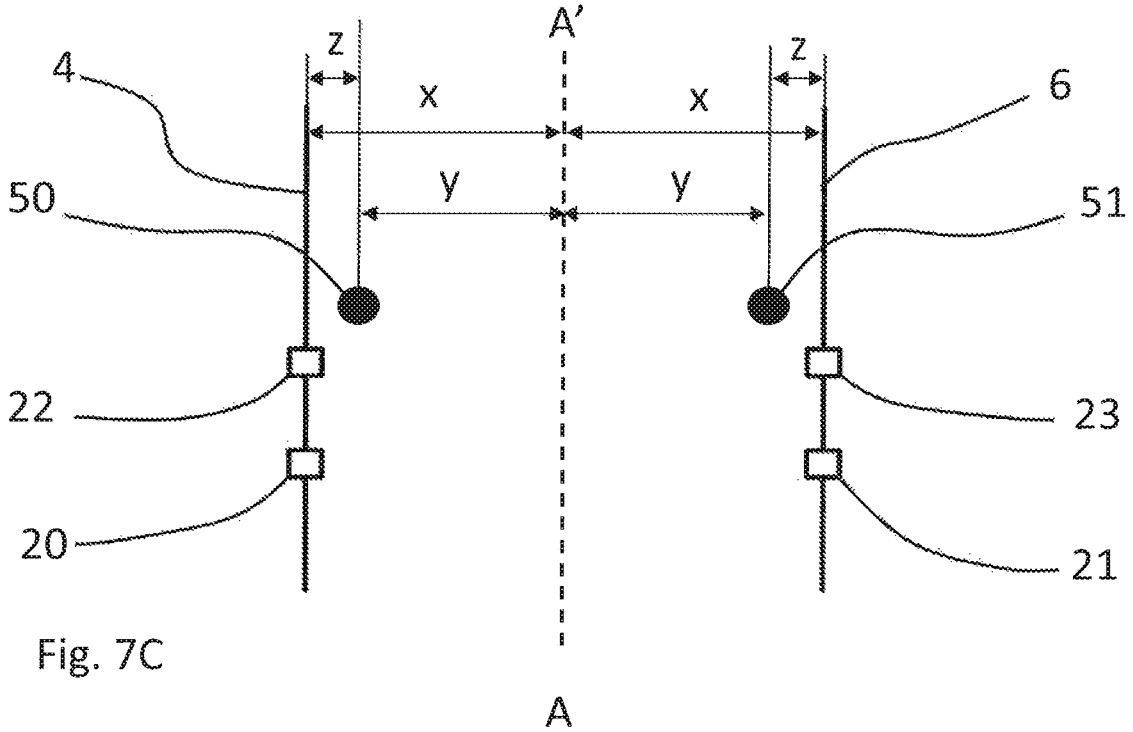
Figure 7D:
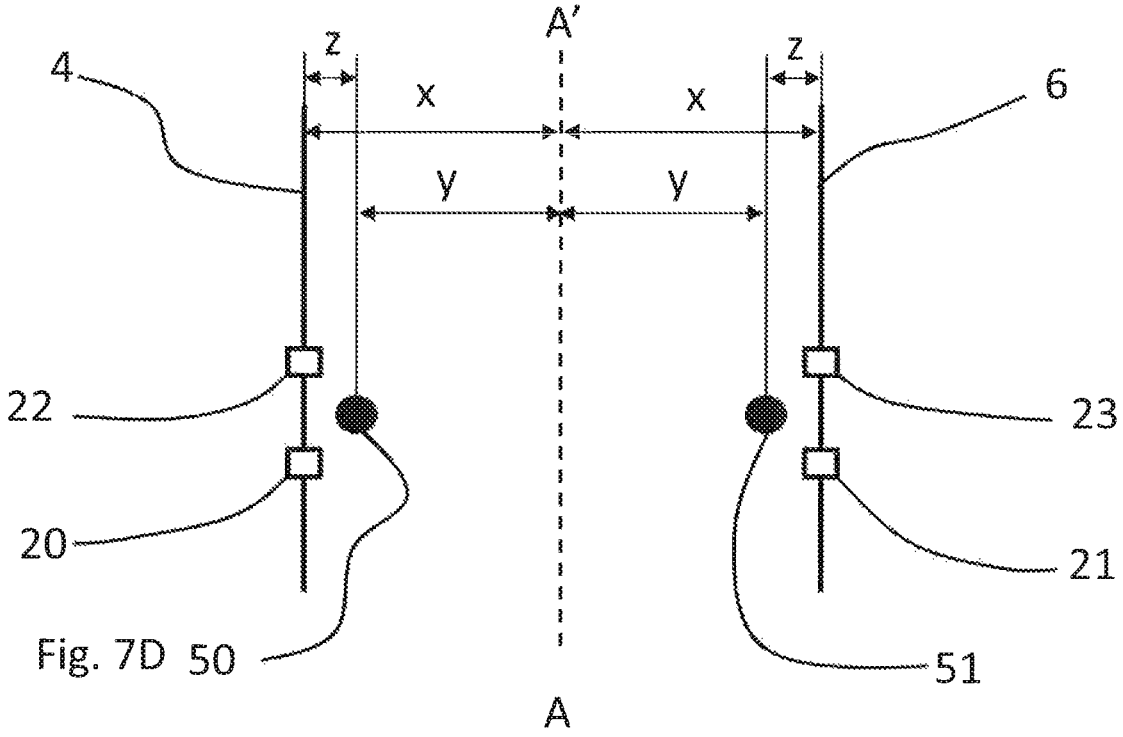

FIGS. 7C and 7D show an embodiment of the over fire air arrangement having at least one first primary over fire air port 20 and at least one first secondary over fire air port 22 provided to the first wall 4 and at least one second primary over fire air port 21 and at least one second secondary over fire air port 23 provided to the second wall 6. The first secondary over fire air port 22 is arranged in vertical direction above the first primary over fire air port 20 and the second secondary over fire air port 23 is arranged in vertical direction above the second primary over fire air port 21.

In the embodiment of FIG. 7C the first and second additional over fire air ports 50, 51 are arranged such that the first and second additional over fire air ports 50, 51 are in vertical direction above the first and second secondary over fire air ports 22, 23. In one embodiment the first and second additional over fire air ports 50, 51 may in vertical direction less than 2.0 m, preferably between 0.3-1.0 m, above the first and second secondary over fire air ports 22, 23.

In the embodiment of FIG. 7D the first and second additional over fire air ports 50, 51 are arranged such that the first and second additional over fire air ports 50, 51 are in vertical direction between the first and second primary over fire air ports 20, 21 and the first and second secondary over fire air ports 22, 23. In one embodiment the first and second additional over fire air ports 50, 51 may be in vertical direction between the first and second primary over fire air ports 20, 21 and the first and second secondary over fire air ports 22, 23 and less than 2.0 m, preferably 0.3-1.0 m, above the first and second primary over fire air ports 22, 23.

The over fire air arrangement may also comprise at least one first primary additional over fire air port 50 and at least one first secondary additional over fire air port 52. The at least one first secondary additional air port 52 is arranged in vertical direction above the at least one first primary additional air port 50.

Figure 8:
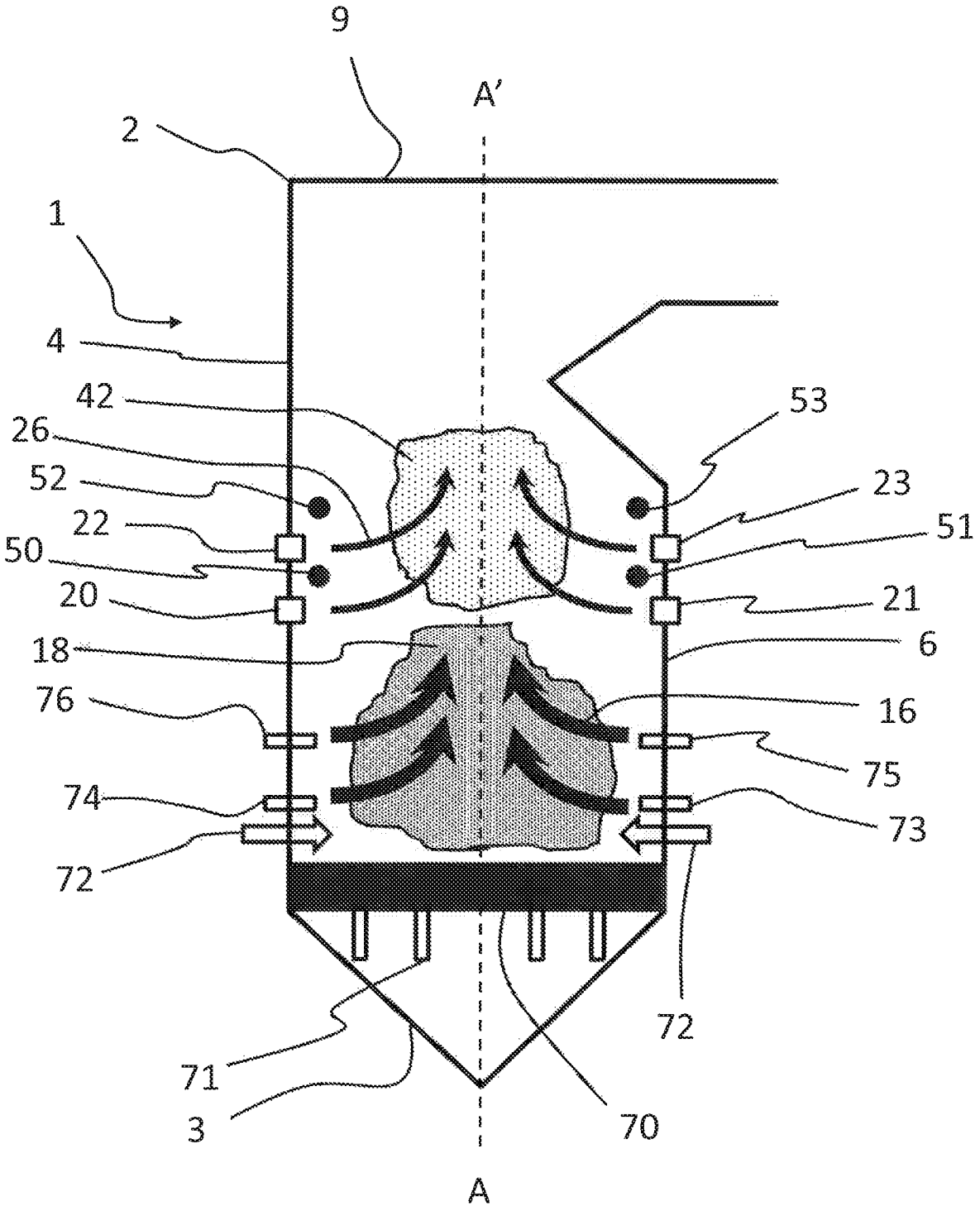
FIG. 8 shows a furnace with yet another embodiment of the over fire arrangement according to the present invention.

FIG. 8 shows an embodiment of the present invention in which the over fire air arrangement comprises at least one first primary additional over fire air port 50 and at least one first secondary over fire air port 52, as well as at least one second primary additional over fire air port 51 and at least one second secondary over fire air port 53. The at least one first secondary additional air port 52 is arranged in vertical direction above the at least one first primary additional air port 50 and the at least one second secondary additional air port 53 is arranged in vertical direction above the at least one second primary additional air port 51. The at least one first and second secondary over fire air ports 52, 53 supply first and second secondary additional over fire air flows 62, 63 to the oxygen lean areas 44, 46.

The furnace of FIG. 8, is grate furnace having grate 70 on to which fuel is supplied through fuel supply ports 72. Primary air ports 71 are provided under the grate 70 and secondary and tertiary air ports 72, 73 and 74, 75 are provided to the first and second wall 4, 6 respectively. The tertiary air ports 76, 75 are provided in vertical direction above the secondary air ports 72, 73. The furnace could also be bubbling fluidized bed furnace in which the grate 70 is replaced with fluidized bed.

It should be noted that in some embodiments of a grate furnace, the secondary and tertiary air ports 72, 73 and 74, 75 may be omitted and there is only primary air ports 72 and the over fire air arrangement.

This configuration of the over fire air arrangement may be utilized when there are at least one first primary over fire air port 20 and at least one first secondary over fire air port 22 provided to the first wall 4 and at least one second primary over fire air port 21 and at least one second secondary over fire air port 23 provided to the second wall 6. This enables increasing the height of the additional over fire air supply to the first and second oxygen lean over fire air areas 44, 46, as shown in FIGS. 9A, and 9B.

The first primary and secondary and second primary and secondary additional over fire air ports 50, 51, 52, 53 may be arranged such that both the first primary and secondary and second primary and secondary additional over fire air ports 50, 51, 52, 53 are in vertical direction above the first and second over fire air ports 20, 21, 22, 23 (not shown) or below the first and second secondary over fire air ports 22, 23, as in FIG. 10C. In the embodiment of FIG. 10C, the first and second primary additional over fire air ports 50, 51 are at the first distance z from the first and second side walls 4, 6, respectively. The first and second secondary additional over fire air ports 52, 53 are at the fourth distance q from the first and second side walls 4, 6, respectively. The fourth distance q is greater than the distance z and both the first distance z and fourth distance q are smaller than the fifth distance w between the vertical centre line A-A' of the furnace 1 and the first and second secondary additional over fire air ports 52, 53.

The a fourth distance q between the first and second secondary additional air port 52, 53 and the first and second wall 4, 6, respectively, is smaller than or equal to one third of a third distance x between the a vertical centre line A-A' of the furnace enclosure 2 and the first and second wall 4, 6, respectively. In an alternative embodiment the first and second secondary additional over fire air ports 52, 53 are arranged such that the fourth distance q between the first and second secondary additional air port 52, 53 and the first and second wall 4, 6, respectively, is smaller than 2.0 m, or preferably the first distance z is between 0.3-1.0 m.

Figure 9A:
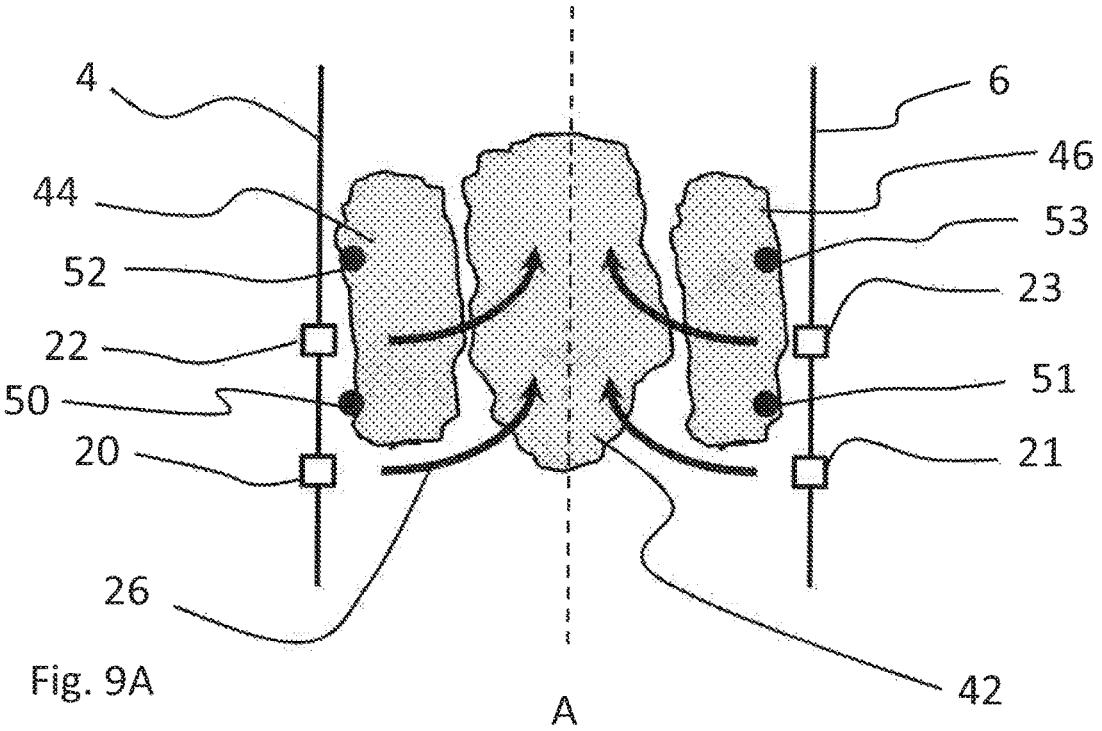
FIGS. 9A and 9B show the over fire air arrangement of FIG. 8.
Figure 9B:
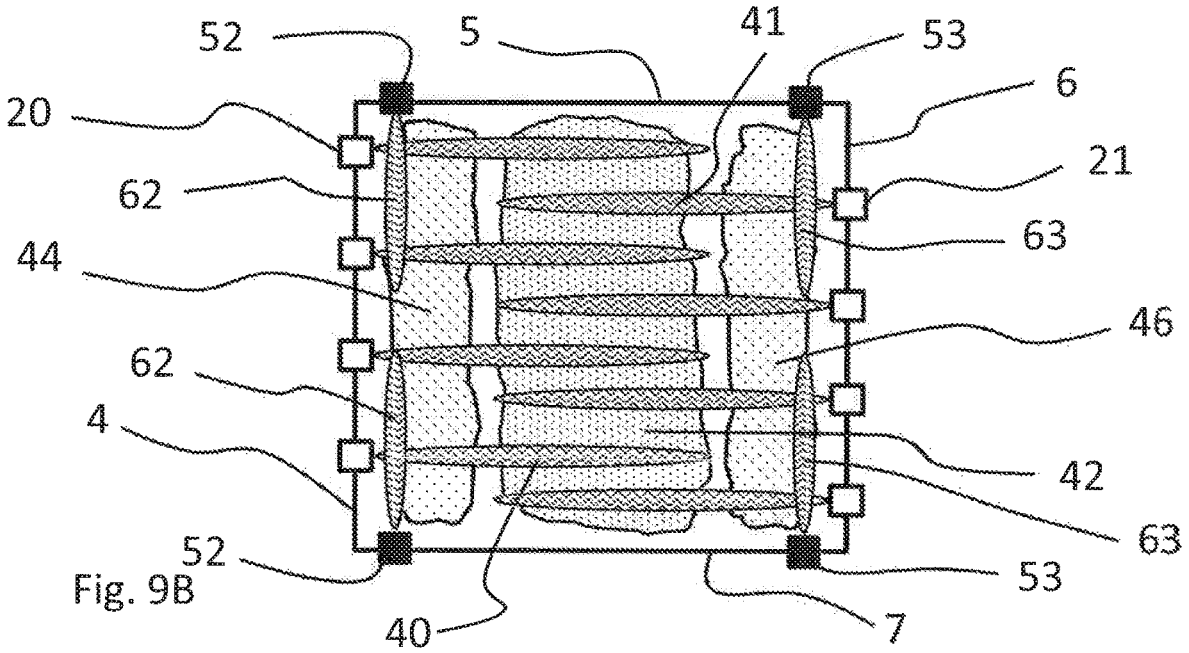
Figure 10A:
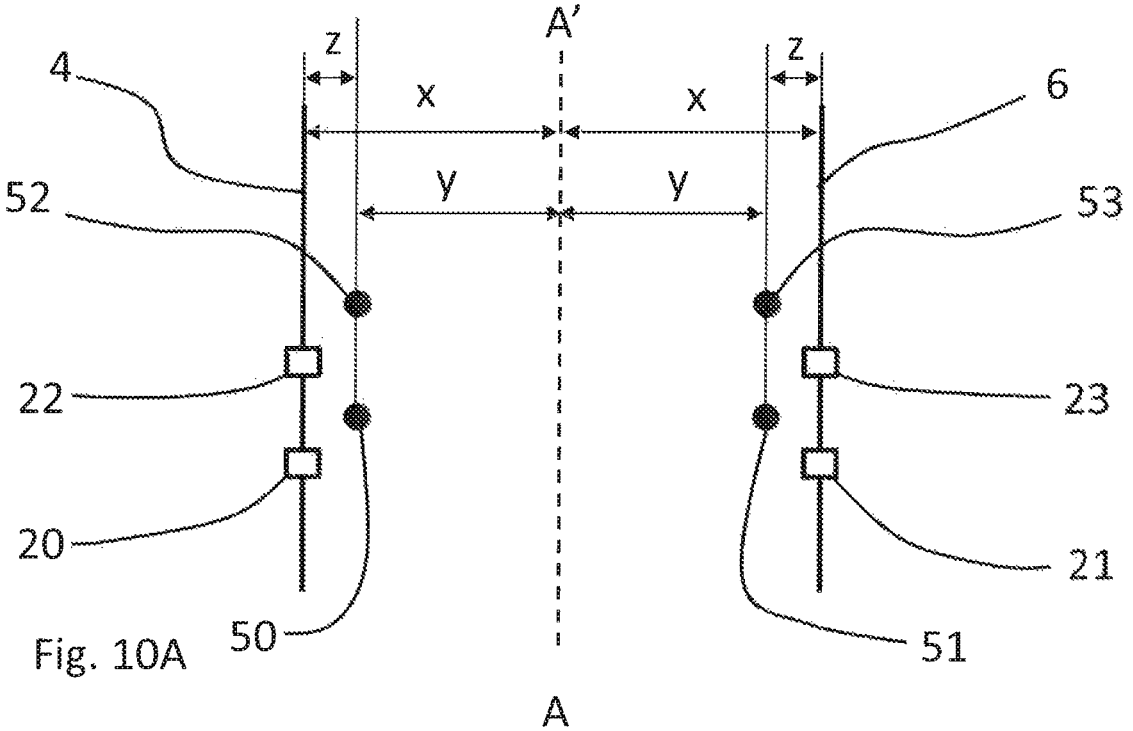
FIGS. 10A, 10B and 10C show different embodiments of the over fire arrangement for the furnace of FIG. 8.
Figure 10B:
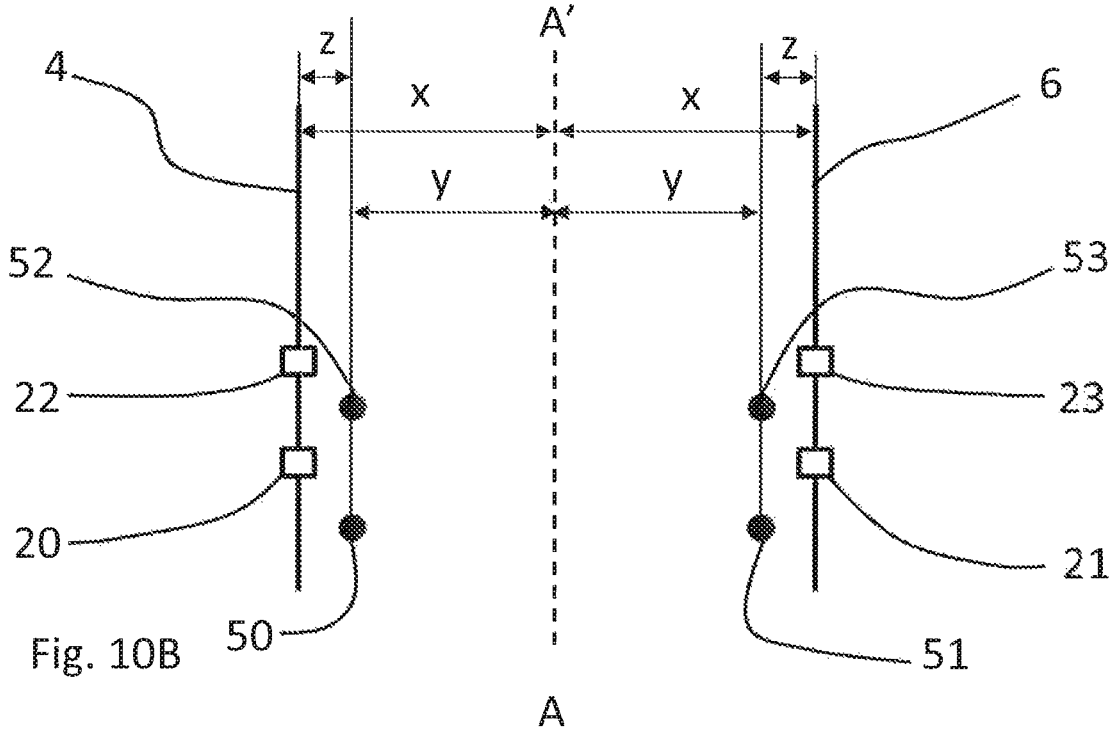
Figure 10C:
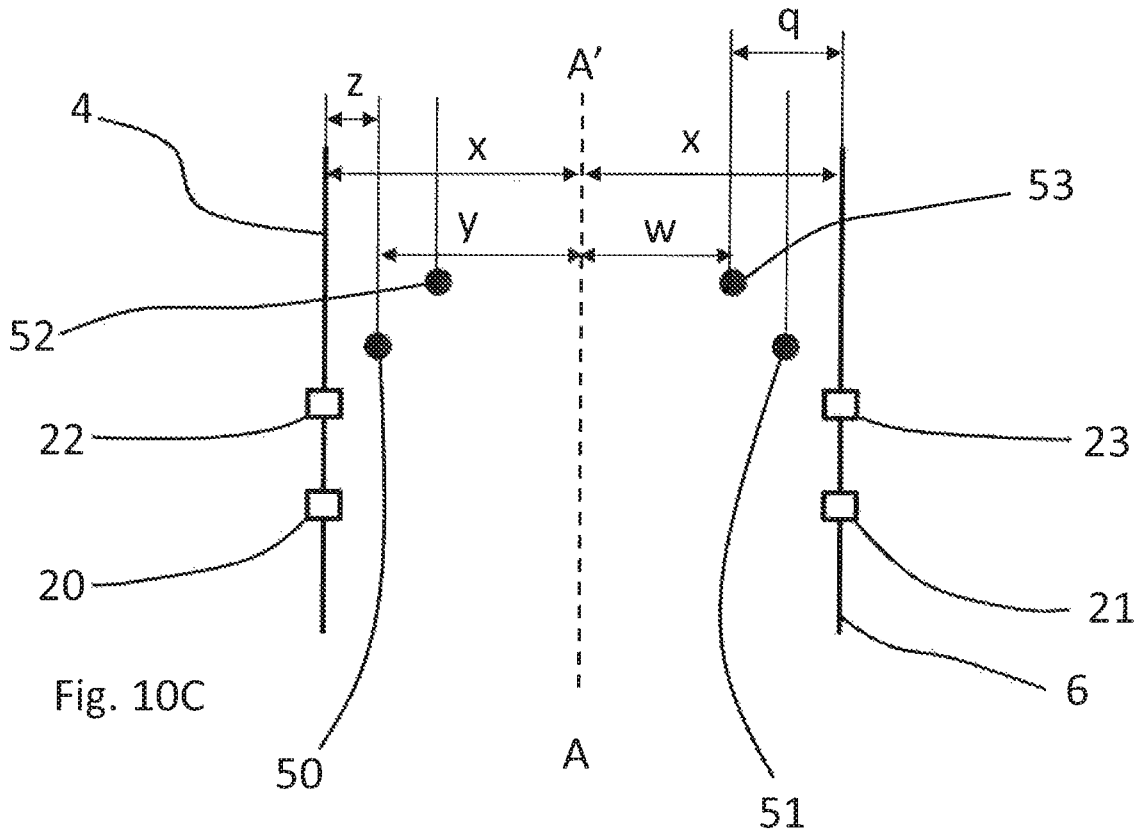

FIGS. 10A and 10B show different kinds of over fire air arrangement according to the over fire arrangement of FIGS. 8, 9A and 9B. All the alternatives are in the scope of the present invention.

FIG. 10A shows an embodiment in which the first and second primary additional over fire air ports 50, 51 are in vertical direction above the first and second over fire air ports 20, 21 and between the first and second over fire air ports 20, 21 and the first and second secondary over fire air ports 22, 23. The first and second secondary additional over fire air ports 52, 53 are in vertical direction above the first and second secondary over fire air ports 22, 23.

FIG. 10B shows an embodiment of the over fire air arrangement in which the first and second primary additional over fire air ports 50, 51 are in vertical direction below the first and second primary over fire air ports 20, 21, and the first and second secondary additional over fire air ports 52, 53 are in vertical direction between the first and second primary over fire air ports 20, 21 and the first and second secondary over fire air ports 22, 23.

In an alternative embodiment the both the first primary and secondary and second primary and secondary additional over fire air ports 50, 51, 52, 53 may be in vertical direction between the first and second primary over fire air ports 20, 21 and the first and second secondary over fire air ports 22, 23. In another alternative embodiment the first and second primary additional over fire air ports 50, 51 may be in vertical direction between the first and second primary over fire air ports 20, 21 and the first and second secondary over fire air ports 22, 23, and the first and second secondary additional over fire air ports 52, 53 are in vertical direction above the first and second secondary over fire air ports 22, 23.

When the over fire air arrangement comprises the first primary and secondary and second primary and secondary additional over fire air ports 50, 51, 52, 53, the momentum of the additional over fire air flows 62, 63 of the first and second secondary over fire air ports 52, 53 is lower than the momentum of the additional over fire air flows 60, 61 of the first and second secondary over fire air ports 50, 51, arranged below the first and second secondary over fire air ports 52, 53. Momentum means product of mass flow of the air and air velocity from the additional over fire air ports.

The present invention further provides a furnace 1 for combustion of fuels. The furnace comprises a bottom 3, first and second opposing walls 4, 6 extending in vertical direction from the bottom 3 and first and second opposing side walls 5, 7 between the first and second opposing walls 4, 6. The first and second opposing walls 4, 6 form together with the first and second opposing side walls 5, 7 a furnace enclosure 2. The furnace 1 further comprises a lower furnace 100 comprising a) at least one primary combustion air supply port 71 and at least one secondary combustion air supply port 74, 73 in vertical direction above the at least one primary combustion air supply port 71 for providing staged combustion, the at least one primary combustion air supply port 71 and the at least one secondary combustion air supply port 74, 73 being arranged to the first wall 4 or the first and second wall 4, 6, or b) at least one primary burner 14, 15 and at least one secondary burner 12, 13 in vertical direction above the at least one primary burner 14, 15 for providing staged combustion, the at least one primary burner 14, 15 and the at least one secondary burner 12, 13 being arranged to the first wall 4 or the first and second wall 4, 6.

The furnace 1 further comprises an the over fire arrangement according to present invention. The furnace 1 may be a bubbling fluidized bed furnace, a grate furnace or a pulverized fuel furnace, such as pulverized coal or peat furnace.

The present invention also provides a method for supplying over fire air into a furnace 1. The method comprises supplying a first over fire air flow 40 from the first wall 4 into the furnace 1 and supplying a first additional over fire air flow 60 from at least one of the first and second side walls 5, 7 in the vicinity of the first wall 4 and transversely to the first over fire air flow 40.

In an alternative embodiment the method further comprises supplying a second over fire air flow 41 from the second wall 6 into the furnace 1 and supplying a second additional over fire air flow 61 from at least one of the first and second side walls 5, 7 in the vicinity of the second wall 4 and transversely to the second over fire air flow 41.

The first and second additional over fire air flows 60, 61 may be supplied along the first and second walls 4, 6 respectively, and/or parallel the first and second walls 4, 6 respectively. In one embodiment the first and second additional over fire air flows 60, 61 may be supplied perpendicularly to the first and second over fire air flows 40, 41. In another embodiment the first and second additional over fire air flows 60, 61 from the first and second side walls 5, 7, respectively, at a first distance z from the first and second walls 4, 6, respectively. The first distance z is smaller than a second distance y between the first and second additional over fire air flows 60, 61 and a vertical centre line A-A' of the furnace enclosure 2.

The method also comprises supplying 10-35%, preferably 20 to 35%, of total amount of over fire air with the first and second additional over fire air flows 60, 61.

It will be obvious to a person skilled in the art that, as the technology advances, the inventive concept can be implemented in various ways. The invention and its embodiments are not limited to the examples described above but may vary within the scope of the claims.

The invention claimed is:

1. An over fire air arrangement for a bubbling fluidized bed furnace, the furnace having opposing first wall and second wall and opposing first side wall and second side wall between the first and second walls for forming a furnace enclosure, the over fire air arrangement comprising:

at least one first over fire air port provided to the first wall for supplying a first over fire air flow into the furnace, at least one second over fire air port provided to the second wall for supplying a first over fire air flow into the furnace, at least one first additional over fire air port provided to the first side wall in the vicinity of the first wall so that the at least one first additional over fire air port is arranged closer to the first wall than its distance to a vertical centre line of the furnace enclosure, the at least one first additional over fire air port being arranged to supply along the first wall a first additional over fire air flow into the furnace transversely to the first over fire air flow, at least one further first additional over fire air port provided to the second side wall in the vicinity of the first wall so that the at least one further first additional over fire air port is arranged closer to the first wall than its distance to a vertical centre line of the furnace enclosure, the at least one further first additional over fire air port being arranged to supply along the first wall a further first additional over fire air flow into the furnace transversely to the first over fire air flow, at least one second additional over fire air port provided to the first side wall in the vicinity of the second wall so that the at least one second additional over fire air port is arranged closer to the second wall than its distance to the vertical centre line of the furnace enclosure, the at least one second additional over fire air port being arranged to supply along the second wall a second additional over fire air flow into the furnace transversely to the second over fire air flow, and at least one further second additional over fire air port provided to the second side wall in the vicinity of the second wall so that the at least one further second additional over fire air port is arranged closer to the second wall than its distance to the vertical centre line of the furnace enclosure, the at least one further second additional over fire air port being arranged to supply along the second wall, a further second additional over fire air flow into the furnace transversely to the second over fire air flow, wherein at least one first secondary over fire air port provided to the first wall above the first over fire air port and above the at least one first additional over fire air port, at least one second secondary over fire air port provided to the second wall above the second over fire air port and above the at least one second additional over fire air port, the at least one first additional over fire air port, the at least one further first additional over fire air port, the at least one second additional over fire air port and the at least one further second additional over fire air port being in vertical direction above the at least one first over fire air port and the at least one second over fire air port and below the at least one first secondary over fire air port and the at least one second secondary over fire air port, at least one first secondary additional over fire air port provided to the first side wall in the vicinity of the first wall so that the at least one first secondary additional over fire air port is arranged closer to the first wall than its distance to the vertical centre line of the furnace enclosure, the at least one first secondary additional over fire air port being positioned in the vertical direction above the at least one first additional over fire air port and arranged to supply along the first wall a first secondary additional over fire air flow into the furnace transversely to the first over fire air flow, at least one further first secondary additional over fire air port provided to the second side wall in the vicinity of the first wall so that the at least one further first secondary additional over fire air port is arranged closer to the first wall than its distance to the vertical centre line of the furnace enclosure, the at least one further first secondary additional over fire air port being positioned in the vertical direction above the at least one further first additional over fire air port and arranged to supply along the first wall a further first secondary additional over fire air flow into the furnace transversely to the first over fire air flow, at least one second secondary additional over fire air port provided to the first side wall in the vicinity of the second wall so that the at least one second secondary additional over fire air port is arranged closer to the second wall than its distance to the vertical centre line of the furnace enclosure, the at least one second secondary additional over fire air port being positioned in vertical direction above the at least one second addition-al over fire air port and arranged to supply along the second wall a second secondary additional over fire air flow into the furnace transversely to the second over fire air flow, and at least one further second secondary additional over fire air port provided to the second side wall in the vicinity of the second wall so that the at least one second secondary additional over fire air port is arranged closer to the second wall than its distance to the vertical centre line of the furnace enclosure, the at least one further second secondary additional over fire air port being positioned in vertical direction above the at least one second additional over fire air port and arranged to supply along the second wall a further second secondary additional over fire air flow into the furnace transversely to the second over fire air flow, and the at least one first secondary additional over fire air port, the at least one further first secondary additional over fire air port, the at least one second secondary additional over fire air port and the at least one further second secondary additional over fire air port being in vertical direction above the at least one first secondary over fire air port and the at least one second secondary over fire air port.

2. An over fire air arrangement of according to claim 1, wherein the first and second additional over fire air ports are in vertical direction less than 2.0 m above the first and second over fire air ports; or the first and second additional over fire air ports are in vertical direction between 0.3-1.0 m above the first and second over fire air ports.

3. A bubbling fluidized bed furnace for combustion of fuels, the furnace comprising:

a bottom;

first and second opposing walls extending in vertical direction from the bottom;

first and second opposing side walls between the first and second opposing walls, the first and second opposing walls form together with the first and second opposing side walls a furnace enclosure, a lower furnace comprising a) at least one primary combustion air supply port; or b) at least one primary burner and at least one secondary burner in vertical direction above the at least one primary burner for providing staged combustion, wherein the furnace comprises an over fire arrangement according to claim 1.

* * * * *